United States Patent [19]

Cassidy

[11] 4,055,322

[45] Oct. 25, 1977

[54] PERMEABLE LINER HAVING CONCRETE SETTING RETARDANT

[76] Inventor: Hugh I. Cassidy, 2845 Yorba, San Francisco, Calif. 94116

[21] Appl. No.: 631,485

[22] Filed: Nov. 13, 1975

[51] Int. Cl.[2] ..... B28B 7/36

[52] U.S. Cl. ..... 249/187 R; 249/112; 249/114; 249/134; 264/338

[58] Field of Search ..... 249/112–114, 249/134, 103, 104, 187; 264/338

[56] References Cited

U.S. PATENT DOCUMENTS

| | | | |
|---|---|---|---|
| 1,600,674 | 9/1926 | Kass | 249/112 |
| 1,668,723 | 5/1928 | Johnson | 264/338 |
| 2,296,553 | 9/1942 | Heritage et al. | 249/114 |
| 2,654,935 | 10/1953 | Ager | 249/112 |
| 3,844,527 | 10/1974 | Scott | 249/134 |

*Primary Examiner*—Francis S. Husar
*Assistant Examiner*—John McQuade
*Attorney, Agent, or Firm*—Warren, Chickering & Grunewald

[57] ABSTRACT

There is disclosed an article useful for producing concrete with textured patterns which includes a membrane of water permeable material having a pattern prepared on one side thereof with a water soluble retardant for the setting of cement and with the retardant pattern completely covered with a waterproof film that is bonded to the membrane immediately adjacent the retardant pattern. There is also disclosed a method for preparing concrete to have a pattern on its surface employing the article.

8 Claims, 3 Drawing Figures

PERMEABLE LINER HAVING CONCRETE SETTING RETARDANT

BACKGROUND OF THE INVENTION

Concrete is a mixture of portland cement and aggregate. The aggregate is usually a mixture of rocks of different sizes and sand, and the selection of the sizes and character of the aggregate particles is important in determining the quality of the concrete. The cement is a material which, when mixed with water, sets to form a solid monolithic stone-like material. The cement also surrounds and binds the aggregate to form a unitary, hard, strong mass that is the familiar material known generally as concrete. The concrete is stronger than cement by itself and is well-known for its high compressive strength and even its high tensile strength when used in such forms as prestressed concrete.

Concrete is formed by a casting process. Generally, forms are employed to produce hollow cavities in the shape of the desired concrete element, and the forms are filled with moist, pasty concrete and maintained at least until the concrete has set to have green strength, after which the forms are removed and the concrete element remains. Concrete is used with exposed surfaces that are horizontal and facing upwardly, such as in roads and walks. Concrete surfaces are also exposed which are horizontal and facing downwardly, such as in ceilings or the underside of bridges or overpasses. Concrete is also used with vertical faces exposed, such as in walls, columns and foundations.

Although concrete is a mixture of aggregate and cement, the outer surfaces of concrete have the appearance of being just cement, and no aggregate is visible. Concrete surfaces are characteristically an uneven gray color and devoid of large features. Instead, concrete surfaces characteristically have ugly form marks which may be the joints between adjacent elements of the form or the grain of wood. Concrete structural elements are notoriously ugly.

One way to increase the interest and beauty of concrete elements is to remove the surface cement. Removing the surface cement removes mold marks and exposes the aggregate. Aggregate is a much more interesting texture than cement because it does not have a monotonous monolithic appearance and because the various stones that are exposed are in a variety of sizes and have natural and non-repetitive shapes.

To remove the surface layer of cement from a concrete element, certain materials which are known to retard the setting of cement have been applied to the inside of the forms. These materials retard the setting of cement only of the thin surface layer so that when the forms are removed, the thin surface layer can be eroded away to expose the aggregate beneath it. Removing this thin surface layer of cement does not affect the strength of the element. Among the materials that are known to retard the setting of cement are sugars and certain salts, such as aluminum or magnesium halides or aluminum and magnesium saccharates.

Artistic and aesthetic effects can be achieved by applying retardants in patterns so that exposed aggregate in specific patterns becomes a feature of the final concrete element. For example, walks or retaining walls having their exposed surfaces with geometric patterns or even individually produced representations or scenes can be in the form of exposed aggregate, whereas the rest of the wall is in the form of flat cement, may be employed as a desirable architectural feature that is superior to a plain concrete wall or even to a concrete wall, the surface of which is entirely exposed aggregate. However, obtaining sharply defined features in a geometric form or another pattern is difficult to obtain because the concrete setting retardants are water soluble, and when they are in contact with wet concrete during its setting period, they run along the interface between the form and the concrete to produce a blurred pattern or an indistinct outline of the pattern.

THE INVENTION

This invention includes an article for use in making concrete elements which provides a means for forming sharp, distinct patterns of exposed aggregate in any desired shape or form. The article of this invention includes a water permeable membrane having a pattern provided on one side of it with said pattern being delineated in a water soluble retardant which retards the setting of concrete. The article also includes a waterproof film that completely covers the pattern and is bonded to the membrane immediately adjacent the delineation of the pattern. In a preferred embodiment the side of the membrane having the pattern and the waterproof film on it is bonded to a stiff backing sheet so that it may readily be applied to the inside of a concrete form and so that it will remain in its proper position when the form is filled with concrete.

The membrane to be used in the present invention is preferably paper, although equivalent materials, such as water permeable plastic or fabric, may be employed. Paper is preferred because it is the least expensive of such materials and because it can be prepared with any degree of water permeability that is desired. The permeability of paper may be controlled by coating it with aluminum stearate, lacquer or equivalent materials in layers that may be controlled in thickness and in concentration so that water may pass through the membrane in both directions at a controlled rate.

As stated hereinabove, the water soluble retardant is a well-known material for this purpose. Ordinarily sugars are employed as retardants, such as glucose, fructose, molasses, dextrines. The retardant is preferably mixed with materials known to the art to maintain them dry after they have been applied to the surface of the membrane. It is also preferred that the retardant be mixed with a coloring material, such as a dye or a food coloring, so that the pattern made on the membrane by the retardant can be seen. The retardant can be applied in any desired pattern, and in the sense of this description a pattern includes any form or shape that is desired to be visible on the exposed surface of the concrete made with the article of this invention. Patterns may be strictly geometric, or they may be in such forms as flowers, fleur-de-lis, borders or actual representations of persons or scenes, such as silhouettes, mountains, trees, etc. The pattern may be applied by halftone techniques in that the article of this invention permits sharp delineations of pattern elements. The pattern may be applied by printing techniques, or it may be applied by an artist employing ordinary painting techniques. The pattern may also be applied to affect the depth to which cement is removed from the ultimate concrete element by increasing the amount of retardant applied in some portions of the pattern as opposed to other portions of the pattern. This may be done by halftone techniques, or it may be done by simply brushing thicker layers on some portions of the pattern than on others, or it may be done by printing some portions of the pattern more than once, while other portions are printed only once.

The retardant pattern is coated with a waterproof film in such a manner that the waterproof film is bonded to the membrane everywhere except where the pattern exists. In other words, the waterproof film is bonded to the membrane immediately adjacent the areas where the pattern is applied to the membrane whereby the waterproof membrane forms a restricting chamber for the retardant so that the retardant may escape from that chamber only by flowing through the water permeable membrane. The waterproof film preferably is a waterproof glue, such as a vinyl acrylic glue, which may be applied by brushing, spraying or printing techniques to the side of the membrane having the pattern on it. The waterproof film may also be applied as a separate film if it can be bonded to the membrane material by means such as heating or rolling.

In a preferred embodiment of the invention, the side of the membrane having the pattern and waterproof film on it is placed against a stiff backing sheet and bonded to the backing sheet. When the waterproof film is a glue, it can perform the function of acting as the bonding medium to fix the membrane to the stiff backing sheet. The stiff backing sheet preferably is heavy paper or cardboard, and its function is to hold the membrane securely in place while it is being placed against a concrete form and while the form is being filled with concrete. The stiff backing sheet may be provided with adhesive to fix it to the interior of the concrete form, or it may be fixed in the concrete form by means of nails, tacks, or other fastening devices.

Disclosed is a process for producing concrete having a pattern of exposed aggregate on its surface. The pattern may be exposed aggregate, or it may be flat cement with exposed aggregate forming the greater portion of the exposed surface. Thus, if a regular arrangement of repetitive flowers is to be a pattern on the surface of the concrete, exposed aggregate may be in the form of flowers, or, conversely, flat cement may be in the form of flowers with the remainder of the surface being exposed aggregate. In addition, combinations of exposed aggregate and cement may form the pattern.

Disclosed is the method for forming concrete with patterns on its exposed surfaces. The method includes construction of a concrete form by known means and with known materials. The concrete form is lined with an article of this invention as described hereinabove so that the surface of the membrane having the pattern and the waterproof film on it is facing the form while the other surface of the membrane is positioned so that the concrete poured in the form will be in contact with it. When the forms are thus prepared, concrete is poured to fill the form. The water in the concrete saturates the water permeable membrane, penetrates through the membrane and dissolves the retardant. During the process of setting, the concrete draws water from the membrane and retardant saturates the cement in the area directly on the other side of the membrane from the area that the retardant was applied to the membrane. Since the retardant is in the form of a waterproof chamber created by the waterproof film, it cannot run down the back side of the water permeable membrane. Accordingly, the retardant is confined to the immediate area where it was applied to the membrane in the first place. When the setting of the concrete reaches the point where it begins to draw water from the membrane, the water and the retardant saturate the surface of the concrete only in very limited areas where the retardant was applied to the back side of the membrane. Accordingly, those areas of the concrete where cement setting is retarded will correspond very closely to those areas of the membrane where the retardant was applied. When the concrete has sufficient green strength to support itself, the forms may be removed and the concrete must then be subjected to a form of mild erosion that will erode the cement subjected to the action of the retardant but will not erode the cement that was not subjected to the action of the retardant. The mild erosion may be accomplished by washing the concrete surface with a jet of water, a blast of air, mild sandblasting or scratching with a wire brush. It is evident that the manner and intensity of removing the retarded cement will depend upon the relative hardness of the set cement and the retarded cement and the means employed to erode the retarded cement. It has been found that very little skill is required in this step. It has also been found that a long and noncritical time interval is available for accomplishing the erosion step. Obviously, if the concrete is allowed to set too long before the erosion step is accomplished, even the retarded concrete will have set to the degree that it will be hard to remove. It is also obvious that the forms cannot be removed from the concrete element before sufficient green strength has been obtained to support the concrete element. However, many hours are available between a reasonable time for removing the forms and a reasonable time for accomplishing the erosion step so that a comfortable time period is available.

The present invention may be better described with reference to the accompanying drawings.

Figure 1:
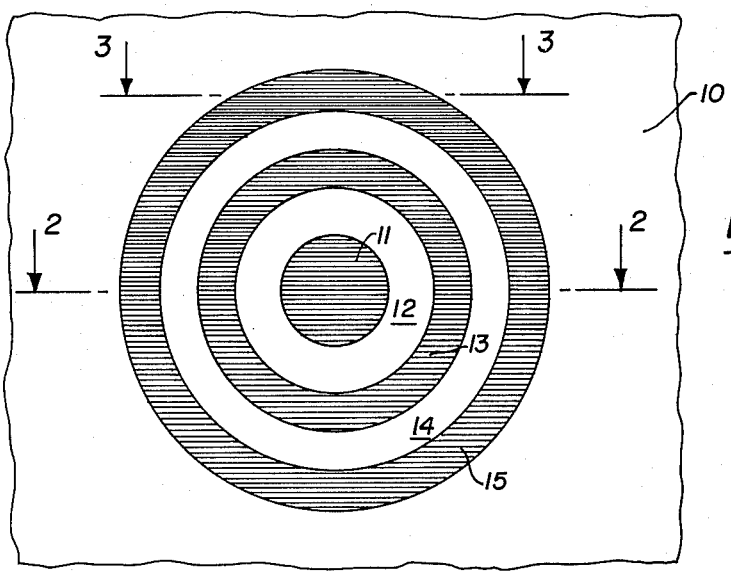
FIG. 1 illustrates a partial view of an article embodying this invention.
Figure 3:
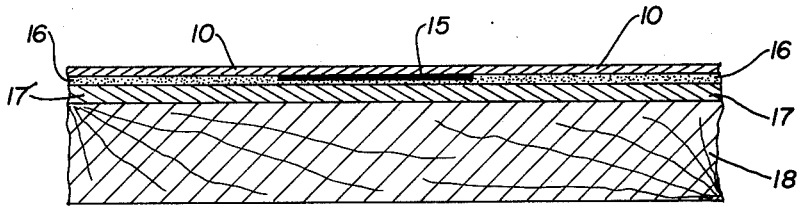
FIG. 3 is a sectional view of the article of FIG. 1 taken along the line 3—3.
Figure 2:
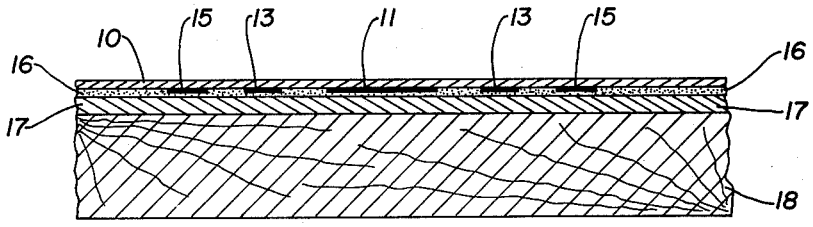
FIG. 2 is a sectional view of the article of FIG. 1 taken along the line 2—2.

In all of the drawings, corresponding parts are identified by the same reference number. FIGS. 2 and 3 are drawn greatly out of scale with each of the layers illustrated being too thick. FIGS. 2 and 3 are drawn in this manner to facilitate observation and illustration.

An article of this invention in the form of a sheet 10 is prepared with a pattern in the form of a target. The target pattern has a bull's-eye 11 in alternating rings 12, 13, 14 and 15 which on the article of this invention are alternating rings of retardant and bare membrane 10. For purposes of illustration, the retardant rings are marked with horizontal lines while the bare membrane is unmarked. Thus, the bull's-eye 11, the ring 13, and the ring 15 are marked with retardant which, in a preferred embodiment, is colored with dye or ink or food coloring to make it visible to one applying the pattern to the membrane or to one fixing the membrane to the interior of a concrete form.

In FIGS. 2 and 3 it is illustrated that the membrane 10 has on the back thereof pattern elements 11, 13 and 15. The back of the membrane 10 also contains a waterproof film 16 which in the embodiment shown covers the entire back surface of the membrane 10 forming a coating on all exposed surfaces of membrane 10 and surrounding each of the retardant covered areas 11, 13 and 15. It is apparent from this illustration that the retardant covered areas 11, 13 and 15 are surrounded on three sides by waterproof film 16 and on one side by water permeable membrane 10. Thus, the only means by which retardant can escape is by water passing through water permeable membrane 10, dissolving the retardant within the chamber formed by waterproof film 16, and then being drawn back through water permeable membrane 10 to its upper surface, as illustrated in FIGS. 2 and 3. It is, of course, apparent that the orientation with regard to vertical is of no consequence and that the upper surface of membrane 10, as illustrated in FIGS. 2 and 3, could be a vertical surface if it were employed to form a retaining wall or a downwardly facing surface if it were employed to form a walk.

Finally, a stiff backing element 17 is fixed to the same side of membrane 10 as the retardant and the waterproof film. As stated hereinabove, the backing element 17 is to provide strength and ease of use to the assembly and is not absolutely an essential element of the invention.

For purposes of illustration, a form 18 is also illustrated. The form 18 may be of rough wood and may have holes, cracks, or lines between adjacent elements, but none of these will show with the embodiment of this invention illustrated herein. In this regard, stiff backing sheet 17 not only permits exact placing of the membrane 10 and holds it in place during pouring of the concrete, but it bridges irregularities in the wooden forms 18, thereby avoiding many of the ugly surface features that may be formed were it not for the article of this invention.

When an article of this invention, as illustrated in the figures, is employed in casting concrete, the forms, lined and prepared as illustrated in FIGS. 2 and 3, are filled with concrete in the usual manner. When the concrete has set sufficiently for the forms to be removed, the forms may be removed and an erosion process, as decribed hereinabove, applied to those portions of the concrete that were in contact with retardant. When the erosion process is effected, a target will form on the concrete element thus made with exposed aggregate in areas 11, 13 and 15, and with smooth cement visible in areas 12 and 14, and of course in all other areas of the cement surface that were not exposed to the action of retardant.

I claim:

1. An article for preparing concrete with a textured pattern on the surface thereof comprising:

A. a water permeable membrane,

B. a pattern on one side of said membrane with said pattern delineated by a water soluble retardant which retards setting of cement, and C. a waterproof film coating said pattern and bonded to said membrane immediately adjacent to the delineation of said pattern.

2. The article of claim 1 wherein said membrane is paper.

3. The article of claim 1 wherein said film is glue.

4. The article of claim 1 wherein said waterproof film is bonded to a stiff backing sheet.

5. The article of claim 1 wherein said retardant contains coloring material.

6. The article of claim 5 wherein said coloring material is food coloring.

7. The article of claim 1 wherein said retardant is a sugar.

8. The article of claim 7 wherein said sugar is glucose.

* * * * *